US005799862A

United States Patent [19]

Gray

[11] Patent Number: 5,799,862

[45] Date of Patent: Sep. 1, 1998

[54] EXPANSIBLE ENVELOPE

[75] Inventor: Larry D. Gray, Chesterfield, Va.

[73] Assignee: Westvaco Corporation, New York, N.Y.

[21] Appl. No.: 863,165

[22] Filed: May 27, 1997

[51] Int. Cl.[6] ..... B65D 27/00

[52] U.S. Cl. ..... 229/68.1; 229/67.3

[58] Field of Search ..... 383/2, 120, 104, 383/124; 229/67.3, 87.03, 87.18, 87.19, 928, 68.1, 67.1

[56] References Cited

U.S. PATENT DOCUMENTS

| | | | |
|---|---|---|---|
| D. 313,040 | 12/1990 | Forbes, Jr. . | |
| D. 322,455 | 12/1991 | Forbes, Jr. . | |
| D. 322,456 | 12/1991 | Forbes, Jr. . | |
| D. 322,457 | 12/1991 | Forbes, Jr. . | |
| 1,767,274 | 6/1930 | Broderick | 383/120 X |
| 1,779,870 | 10/1930 | Appel | 383/124 |
| 2,188,730 | 1/1940 | Swab . | |
| 2,219,526 | 10/1940 | McLaren . | |
| 2,364,297 | 12/1944 | James | 229/87.19 |
| 2,945,616 | 7/1960 | Normandin . | |
| 2,945,617 | 7/1960 | Normandin . | |
| 3,063,618 | 11/1962 | Berkowitz | 229/67.3 |
| 3,073,508 | 1/1963 | Hiersteiner . | |
| 3,552,640 | 1/1971 | Young . | |
| 3,860,164 | 1/1975 | Dworkin . | |
| 4,008,650 | 2/1977 | Alter et al. | 229/67.3 X |
| 4,294,400 | 10/1981 | Gendron | 229/67.1 |

FOREIGN PATENT DOCUMENTS

| | | | |
|---|---|---|---|
| 354355 | 8/1931 | United Kingdom | 383/2 |

*Primary Examiner*—Jes F. Pascua

[57] ABSTRACT

An expansible envelope structure with a single fold bottom is provided with gusset side walls having stress relief score lines in the lower ends thereof which permit normal expansion of the gusset panels.

2 Claims, 1 Drawing Sheet

EXPANSIBLE ENVELOPE

BACKGROUND OF INVENTION

The present invention relates generally to expansible envelopes and more particularly to an expansible envelope construction particularly suited for manufacture using conventional machinery.

Expansible envelopes fall generally into one of two categories. The first, known commercially as a Federal Express type construction, is prepared from a single blank of paperboard wherein the envelope structure comprises front and rear panels joined together at the bottom by a single foldable connection. Such envelopes may also include multiple adjacent scores at the sides and bottom to permit expansion as shown for example, in U.S. Design Pat. Nos. 313,040; 322,455; 322,456; and 322,457. Note also for this type of construction that the closure flap may also include multiple scores to permit expansion. The other category of expansible envelopes is one where the side flaps or panels are of the gusset fold type to permit expansion, and the bottom is also of the gusset fold type so as to achieve a flat bottom when the envelope is expanded. Examples of this type of construction are illustrated in U.S. Pat. Nos. 2,188,730; 2,219,526; 2,945,616; 2,945,617; 3,073,508; 3,552,640; and 3,860,164. When envelopes of the gusset fold type are collapsed prior to use, the gusset panels at the sides and bottom are generally tucked inside the envelope structure between the front and rear panels, although in some cases, the bottom gusset panels may extend outside the envelope structure when the envelope is collapsed. In any event, it will be readily seen that expansible envelopes of the Federal Express type as shown in the aforementioned design patents have only a limited amount of potential expansion, while the gusset fold type envelopes offer substantially more expansion capability depending upon the width of the gusset panels used to make up the sides and bottom. However, because of the relatively simpler construction of the Federal Express type envelope as compared with a gusset fold type envelope, it would be advantageous to achieve greater expansibility in the Federal Express style. According to the present invention, this advantage has been achieved with only minor changes to the Federal Express style construction.

SUMMARY OF INVENTION

In accordance with the present invention, a Federal Express type envelope construction has been modified for increased expansibility. This improvement is accomplished, according to the present invention, by adding gusset type side panels to the envelope structure and by incorporating a unique pattern of stress relief score lines in the gusset panels near the lower ends thereof which permit easy expansion of the gusset panels.

In the past, expansible envelopes with gusset fold side and bottom panels required a separate and independent procedure to bend in the bottom gusset panels as a final step during the fabrication process. That is, even though the prior envelopes were formed from a single blank of envelope material, only the side gusset panels were inwardly folded during ordinary machine operation, and the step of inwardly folding the bottom gusset panels usually was accomplished by hand or by machine in a separate and distinct independent step. However, in accordance with the invention disclosed herein, the improved envelope structure may be formed in a continuous process where the side gusset panels are automatically folded inwardly prior to the rear panel being folded about its conventional single bottom fold line for final assembly.

It is therefore an object of the present invention to provide an expansible Federal Express type envelope made from a single blank with side gussets wherein the side gusset panels are folded in conventionally during regular machine operation.

It is another object of the invention to provide in an expansible Federal Express type envelope strategically placed stress relief score lines near the bottom of the side gusset panels which permit the envelope to be readily expanded despite not having the usual gusset fold bottom panels normally associated with envelopes having side gusset panels. The location and orientation of the stress relief score lines permit the envelope structure to expand easily with a minimum of stress on the bottom fold found in a conventional Federal Express type envelope structure.

Yet another object of the present invention is to provide a method for fabricating an expansible envelope of the Federal Express type wherein the envelope may be expanded by hand, or by the materials placed in the envelope when it is filled.

Other objects of the invention are to provide an improved envelope structure of the character described which is sturdy in construction, easily and economically produced, and both highly efficient and effective in use.

With the above and related objects in view, the invention disclosed herein consists of the details of construction as will be more fully understood from the following detailed description when read in conjunction with the drawings hereinafter described.

DETAILED DESCRIPTION

Figure 1:
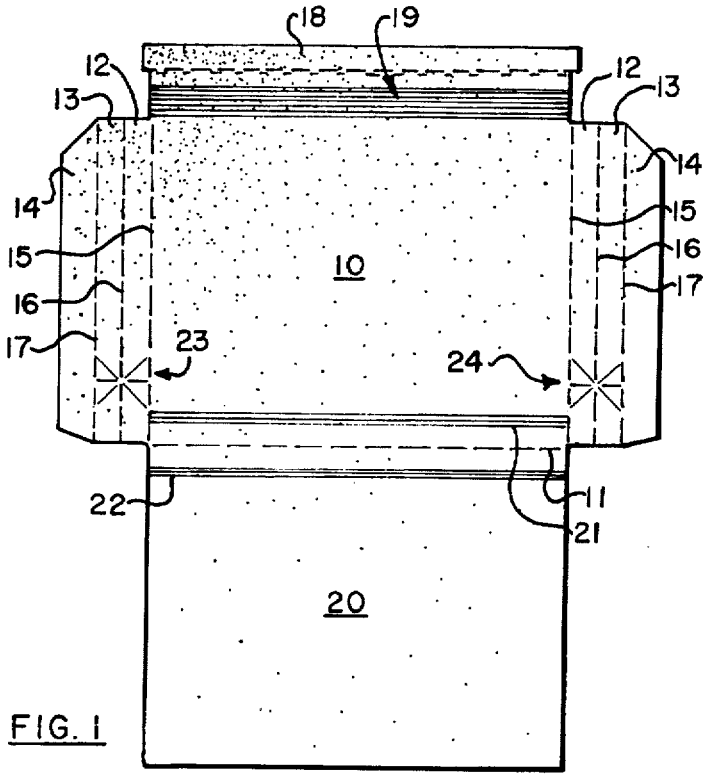
FIG. 1 is a plan view of a paperboard blank from which an expansible envelope embodying the present invention may be formed.

Referring now in greater detail to the drawings in which similar reference characters refer to similar parts, there is illustrated in FIG. 1 a single paperboard blank from which the expansible envelope construction of the present invention may be formed. The blank is so shaped and scored as to enable the formation of the completed envelope on conventional folding and gluing equipment, and, at the completion of the mechanical folding steps, the side gusset panels are folded inwardly and concealed between the front and rear panels. Thus, there is no necessity of manipulating the gusset panels after the envelope is folded and glued, and the completed envelope may be conveniently expanded thereafter into its usable configuration.

The blank itself may be made of paperboard, cardboard, kraft paper, or the like, and for some applications, the blank may be coated on one or both sides with a suitable polymeric material, or a suitable polymeric film may be laminated thereon, for additional strength and moisture resistance. An example of such a film is a biaxially oriented high density polymer sold under the tradename VALERON, supplied by Van Leer Flexible Products, Inc. The means for opening the envelope may include a single or double line tear strip, or a combination sealing/opening two-sided tape application as well known in the art.

The blank comprises a generally rectangular front panel 10 and a rear panel 20 connected together along a single score line 11. At each side of the front panel 10, there are located gusset panels 12, 13 and a glue flap 14. These elements are separated from one another by longitudinal score lines 15, 16 and 17. The combined widths of the gusset panels 12, 13 determines the amount the envelope may be expanded for use. At the top of front panel 10, there is a closure flap 18 foldably connected thereto by a plurality of closely spaced score lines 19. Meanwhile at the bottom of front panel 10 and rear panel 20, there are located additional sets of closely spaced score lines 21, 22, spaced from but in close proximity to single score line 11. The score lines 21, 22 in panels 10 and 20 allow the blank material to flex in a uniform manner when the envelope is expanded for use, and the plurality of score lines 19 provide flexibility in choosing the appropriate point at which the closure flap 18 may be folded when it is desired to close the envelope after filling. Finally, the means provided in the blank to permit the gusset panels to separate and open when the envelope is expanded comprises strategically located stress relief score lines generally referred to by the reference characters 23 and 24 in the lower ends of each of the gusset panels 12 and 13.

Figure 3:
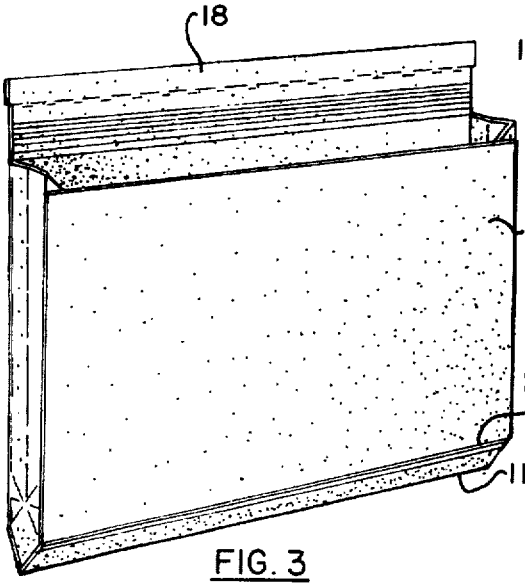
FIG. 3 is a perspective view of the formed envelope partially expanded for accepting its contents.
Figure 2:
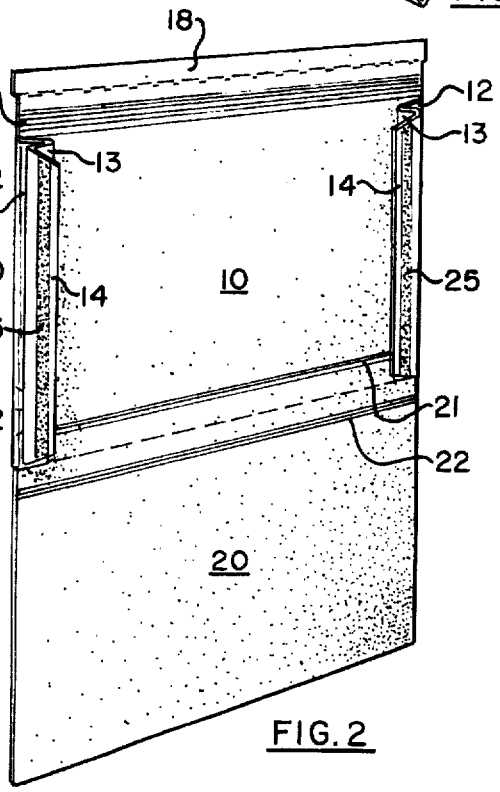
FIG. 2 is a perspective view of the blank of FIG. 1 in partly folded disposition showing the first step in forming the envelope.

FIG. 2 illustrates the blank in partially folded condition during the forming process. Note that gusset panels 12, 13 at each side of front panel 10 are folded inwardly to expose adhesive applications 25, 25 on each side closure flap 14. The envelope construction is completed by folding over rear panel 20 about the single score line 11 so as to adhere panel 20 to side closure flaps 14. The result is the envelope structure shown in FIG. 3 which is illustrated as being partially expanded.

Figure 4:
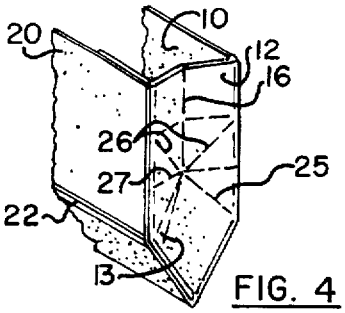
FIG. 4 is a partial perspective view of a bottom corner of the expanded envelope showing the orientation of the stress relief score lines located near the bottom of the side gusset panels.
Figure 5:
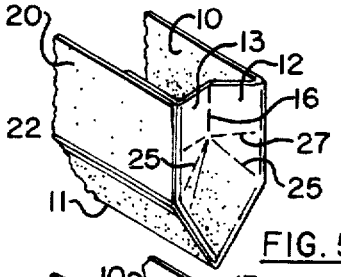
FIG. 5 is a view similar to FIG. 4 showing a second embodiment of the invention; and, FIG. 6. illustrates a third embodiment of the invention.
Figure 6:
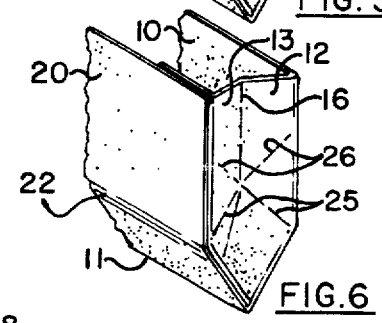

FIGS. 4–6 illustrate different stress relief scoring schemes 23 and 24 for the bottom portions of the gusset panels 12, 13 which facilitate the expansion of the side gussets. In the preferred embodiment illustrated in FIG. 4, a plurality of score lines are used to permit maximum expansion without imposing undue stress on the bottom of the envelope, or on the bonds between the side closure flaps 14 and rear panel 20. A first pair of upwardly extending V-shaped score lines 25 are located in the gusset panels 12, 13 at each side of the envelope. The V-shaped score lines 25 are symmetrical about score line 16 which separates the gusset panels 12, 13 and extend from the score lines 15 and 17 to intersect at score line 16. The preferred distance from the bottom edge of the gusset panels 12, 13 to the intersection of score lines 25 is substantially equal to the combined width of the gusset panels 12, 13. In addition to score lines 25, a second downwardly extending set of score lines 26 may be included in gusset panels 12, 13. As in the case of score lines 25, the score lines 26 intersect at score line 16 and extended downwardly therefrom in symmetrical fashion to terminate at score lines 15 and 17. Finally for additional stress relief, and particularly in the case where the gusset panels 12, 13 are made extra wide for maximum expansion capability, an additional score line 27 may be added to the gusset panels which extends generally perpendicular to score line 16 across the gusset panels 12, 13 through the point where the score lines 25 and 26 intersect. This arrangement allows the gusset panels 12, 13 above stress relief score line 27 to achieve maximum expansion while the expansion below score line 27 may be restricted for further stress relief on the bottom of the envelope and on the bond between side closure flaps 14 and rear panel 20.

FIG. 5 illustrates a first modification for the stress relief score lines 23, 24 wherein the combination of a single pair of upwardly extending V-shaped score lines 25 and an additional score line 27 are included in gusset panels 12, 13. This construction could be used in those cases where the gusset panels were narrow in width for only moderate expansion capability. For additional expansion capability, both upwardly extending score lines 25 and downwardly extending score lines 26 could be used as shown in FIG. 6 without the additional score line 27. The particular score pattern chosen would be selected depending upon the type and weight of material used for the blank and the amount of expansion capability desired.

It will thus be seen that the envelope construction described herein combines the most beneficial features of both a conventional Federal Express type envelope with a single fold at the bottom, and a typical gusset panel type envelope. Moreover, unlike some gusset panel type envelopes, the envelope construction of the present invention retains completely closed bottom corners without the need for additional flaps as is often the case for conventional gusset panel envelopes.

From the foregoing it will be readily apparent that the present invention provides an expansible envelope construction of simple and unique construction that can be readily fabricated on conventional machines. Thus, the foregoing description is intended to be merely descriptive of the invention and in no way limiting. Accordingly, even though several embodiments are completely disclosed, it will be understood that other modifications and changes may be made in the construction of the envelope substantially as contemplated within the scope of the appended claims.

What is claimed is:

1. An expansible envelope prepared from a one piece blank of foldable material comprising a substantially rectangular first panel having top, bottom and side edges, a second panel of the same general size and shape as the first panel foldably attached to the first panel along a single bottom fold line, a closure flap foldably attached to the first panel along a plurality of closely spaced top fold lines, and a pair of gusset panels having bottom edges and a side closure flap foldably attached to each side edge of the first panel along separate longitudinal score lines, the improvement comprising stress relief score lines located above the bottom edges of each pair of gusset panels at each side edge of the first panel wherein said stress relief score lines further comprise a first pair of diagonally oriented score lines which extend upwardly within said gusset panels from the bottom edges thereof to intersect one another along the longitudinal score line joining said gusset panels together, said intersection being located a distance from the bottom edges of the gusset panels that is substantially equal to the combined width of said gusset panels, an additional score line extending across said gusset panels generally perpendicular to the longitudinal score line joining said gusset panels together which passes substantially through the intersection of said first pair of diagonally oriented score lines, and a second pair of diagonally oriented score lines which extend downwardly within said gusset panels to intersect one another at a point which coincides substantially with the point of intersection of the first pair of diagonally oriented score lines.

2. The envelope of claim 1 wherein additional sets of closely spaced score lines are included in each of said first and second panels near the lower ends thereof at locations equidistant from said single bottom score line.

* * * * *